United States Patent [19]

Esquivel

[11] 4,051,566

[45] Oct. 4, 1977

[54] MATTRESS WITH MODIFIABLE CAVITY FOR PREGNANT WOMEN

[76] Inventor: Lucy C. Esquivel, 509 E. Pershing, Gallup, N. Mex. 87301

[21] Appl. No.: 724,931

[22] Filed: Sept. 20, 1976

[51] Int. Cl.[2] ..... A61G 7/04

[52] U.S. Cl. ..... 5/91; 5/327 R

[58] Field of Search ..... 5/90, 91, 338, 327 R, 5/327 B

[56] References Cited

U.S. PATENT DOCUMENTS

| | | | |
|---|---|---|---|
| 686,831 | 11/1901 | Nason | 5/90 |
| 2,215,757 | 9/1940 | Hurst | 5/90 |
| 3,378,862 | 4/1968 | Skinner | 5/91 |
| 3,822,425 | 7/1974 | Scales | 5/91 |
| 3,922,735 | 12/1975 | Kato | 5/91 |

FOREIGN PATENT DOCUMENTS

| | | | |
|---|---|---|---|
| 525,329 | 1/1954 | Belgium | 5/90 |
| 518,433 | 2/1931 | Germany | 5/90 |

*Primary Examiner*—Kenneth Downey
*Attorney, Agent, or Firm*—Warren F. B. Lindsley

[57] ABSTRACT

A mattress structure with modifiable cavity extending therethrough for accommodating the expandable abdomen of a woman during a full term pregnancy. An insert is movably mounted in the cavity such that the bed may have its normal plane surface configuration or a modified cavity in its surface such that a woman resting upon the mattress face down can rest her abdomen in the cavity and have it sized such that the periphery of the cavity serves as a contacting support for the expanding abdomen during the progressive stages of pregnancy.

4 Claims, 7 Drawing Figures

MATTRESS WITH MODIFIABLE CAVITY FOR PREGNANT WOMEN

BACKGROUND OF THE INVENTION

This invention relates to mattresses and mattress supporting structures and more particularly to a mattress and supporting structure having a cavity in its upper surface thereof for receiving a protuberant portion of a person resting on the mattress so that maximum support may be provided with a minimum amount of discomfort.

DESCRIPTION OF THE PRIOR ART

Heretofore maternity mattresses have been provided with cavities in their upper surfaces shaped to accommodate expanded abdomens of women as evident from U.S. Pat. No. 3,378,862. This patent merely discloses a fixed size and shape cavity having a stretchable panel spanning the distance across the cavity which is held in place on the upper surface of the mattress by the ticking. The panel flexes into the cavity when a pregnant women rests on the mattress face down. The stretchable panel, however, does not form a firm supporting surface for the abdomen of the woman.

U.S. Pat. No. 3,840,920 discloses an adjustable mattress for pregnant mothers employing a layer of substantially non-resilient but flowable material below the top resilient layer of the mattress. This material distributes itself to conform to the general contour of the body.

U.S. Pat. No. 3,742,528 discloses a mattress for invalids having removable inserts at locations proximate pressure sensitive parts of a patient's body.

U.S. Pat. No. 3,828,378 discloses a mattress having a plurality of upstanding tufts of differing heights and compression modules. The inserts and tufts of the disclosed mattresses in the above references, however, are not adjustable.

SUMMARY OF THE INVENTION

In accordance with the invention claimed, a new and improved mattress and mattress structure is disclosed employing a modifiable cavity for pregnant women wherein the walls of the cavity firmly support the abdomen of the woman. The cavity size of the mattress is controllable by means mounted on the bed supporting the mattress which moves a conforming cavity insert into the cavity.

Accordingly, it is an object of this invention to provide an improved mattress and mattress supporting structure for use by pregnant women.

Another object of this invention is to provide an improved mattress and mattress supporting structure for pregnant women which employs a cavity the walls of which support the abdomen of a woman and the size of which is variable.

A further object of this invention is to provide a mattress and supporting structure having a cavity extending therethrough which has movably mounted in the cavity a cavity insert which fills the cavity in one position rendering the mattress supporting surface flat but is movable by the user to a plurality of positions thereby changing the cavity size at will.

A still further object of this invention is to provide a mattress having an expandable and contractable cavity for the abdomen of pregnant women wherein the cavity wall firmly supports the abdomen of the women in any chosen caviy size.

Further objects and advantages of this invention will become apparent as the following description proceeds and the features of novelty which characterize the invention will be pointed out with particularlity in the claims annexed to and forming part of this specification.

BRIEF DESCRIPTION OF THE DRAWING

The present invention may be readily described by reference to the accompanying drawing, in which.

DESCRIPTION OF THE PREFERRED EMBODIMENT

Figure 1:
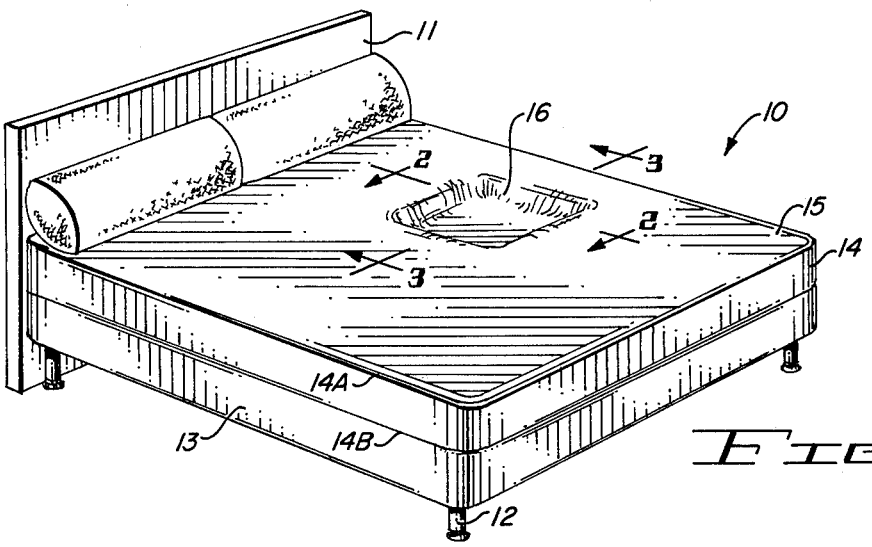
FIG. 1 is a perspective view of a bed having a mattress and supporting structure embodying the invention.

Referring more particularly to the drawing by characters of reference, FIGS. 1–4 discloses a bed 10 which for purpose of illustration only may have a headboard 11 and a frame 12 for supporting a box spring 13 or other suitable support for a mattress 14. The mattress may be covered with a mattress cover 15.

Mattress 14, as shown, embodies the principles and concepts of the instant invention and may be of any suitable substantially rectangular shape of resilient material such as foam rubber or the like. Mattress 14 has a substantially rectangular and planar upper surface 14A and similar planar bottom surface 14B. A cavity 16 extends downwardly from the upper surface 14A through the mattress and may be of any suitable configuration which will permit a like shaped cavity insert to move longitudinally therethrough.

As shown in FIGS. 1–4, the mattress supporting structure or box spring 13 has a similar cavity 16A of like shape and configuration as cavity 16 in mattress 14 which is longitudinally aligned therewith.

Mattress 14 and box spring 13 are provided with cavity inserts 14C and 13C, respectively, which are similar to the cavity configurations 16 and 16A in mattress 14 and box spring 13 but of slightly smaller size so that they can be moved readily in these cavities.

Figure 2:
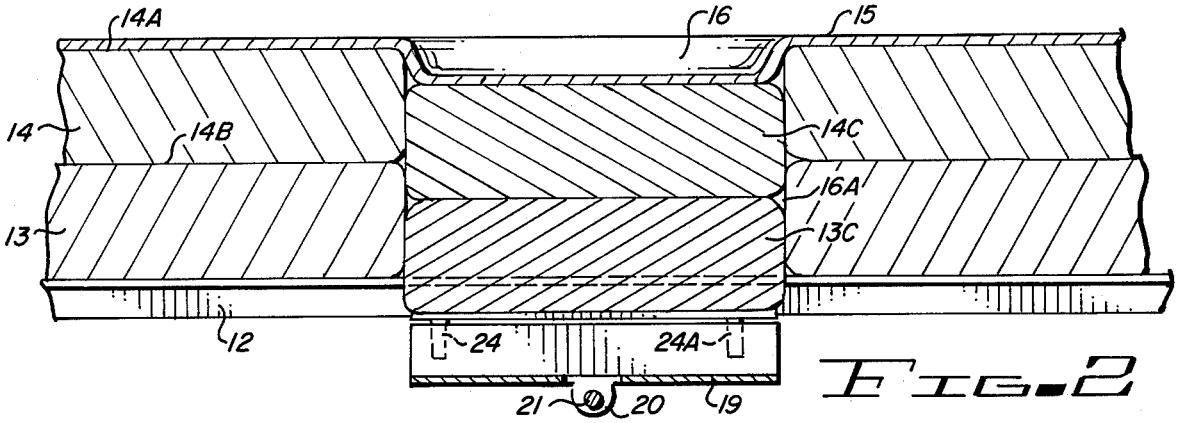
FIG. 2 is a cross sectional view of FIG. 1 taken along the line 2—2.
Figure 3:
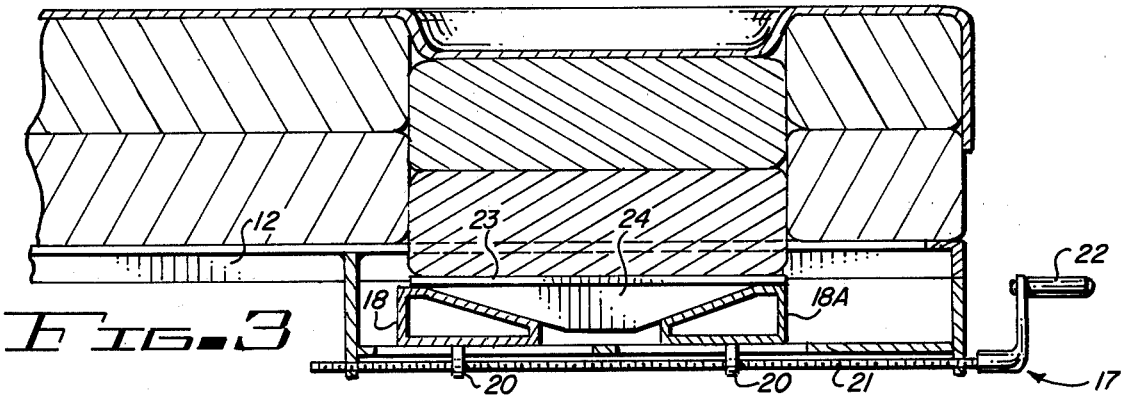
FIG. 3 is a cross-sectional view of FIG. 1 taken along the line 3—3.
Figure 4:
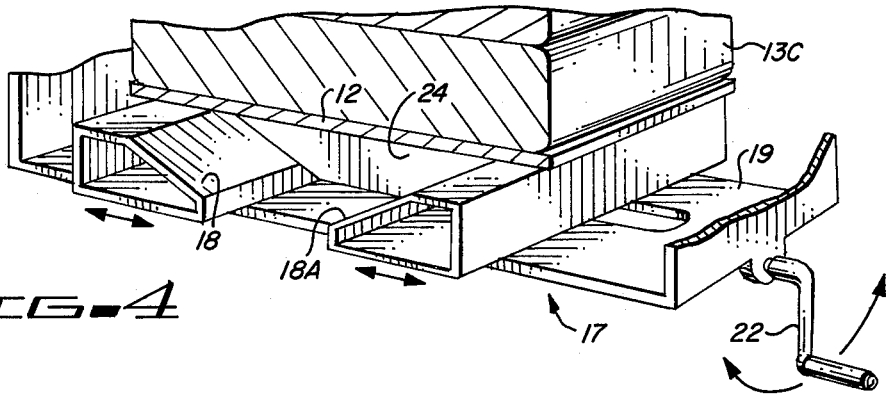
FIG. 4 is an enlarged perspective view of the cavity insert supporting and moving mechanism shown in FIGS. 2 and 3.

In order to controllably move these cavity inserts, a suitable mechanism 17 is provided, as shown in FIGS. 2–4, this mechanism comprises a wedge member comprising a pair of wedge surface portions 18, 18A which are slidably mounted on a slotted supporting plate member 19. Each wedge surfaced portion 18, 18A is provided with an ear 20 which is threadedly associated with a threaded rod 21. Rod 21 is supported on plate member 19 which in turn is suitably attached to frame 12 of the bed. Thus, as handle 22 of rod 21 is rotated it causes wedge surfaced portions 18, 18A to move to and from each other causing a supporting plate 23 and a pair of spaced angled rails 24, 24A resting thereon to move cavity inserts 13C and 14C within and longitudinally of their respective cavities, as shown in FIGS. 2 and 3. It should be noted that rod 21 may be actuated by any suitable means such as fluid actuating means 31 or electric motors 33 of FIGS. 5–7.

Figure 5:
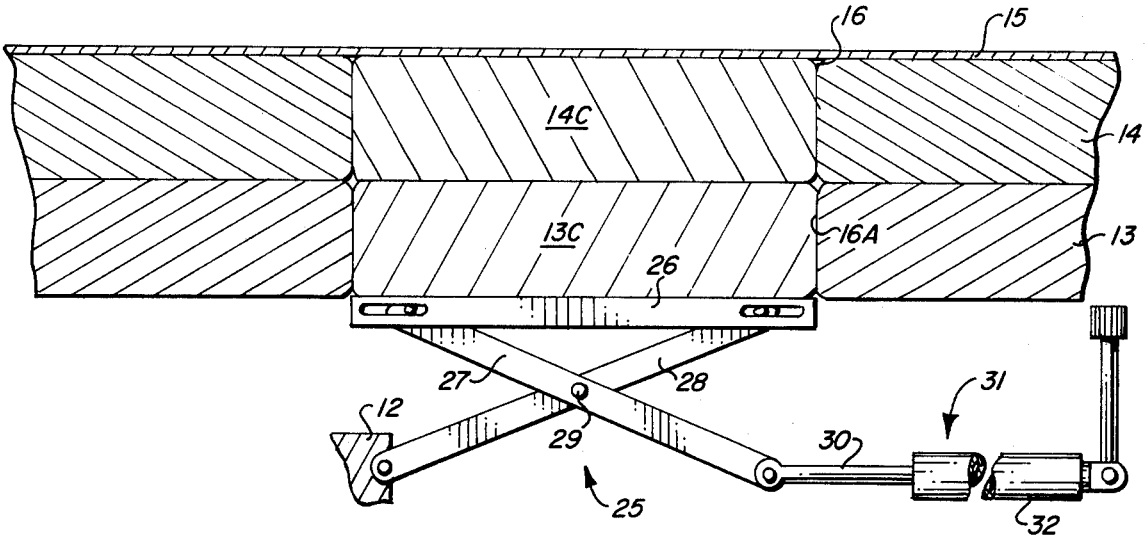
FIG. 5 is a partial view of a mattress and supporting structure embodying the invention and illustrating a modification of the cavity supporting and moving mechanism shown in FIGS. 2–4.
Figure 6:
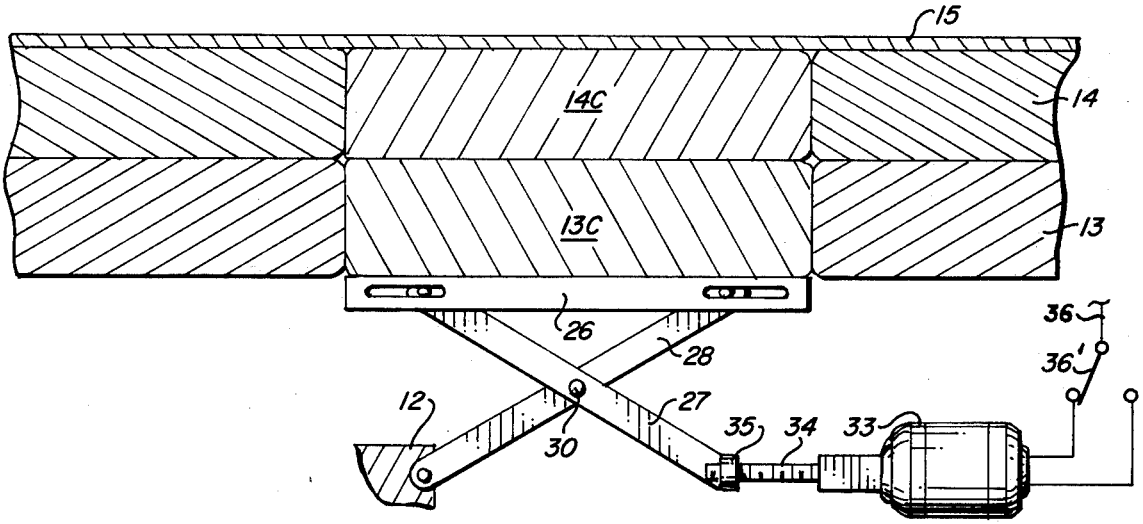
FIG. 6 is an illustration of a modification of the cantilever cavity supporting and moving mechanism shown in FIG. 5 employing and electric motor driving means.
Figure 7:
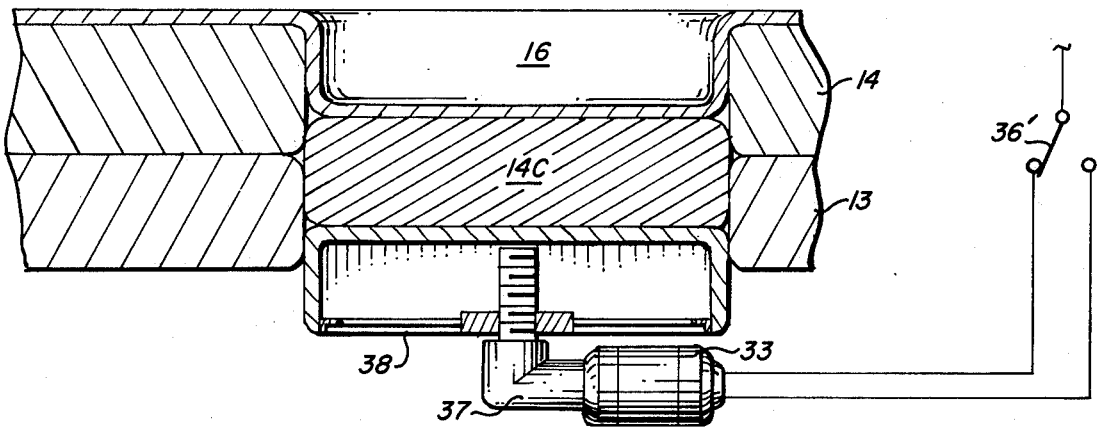
FIG. 7 is an enlarged partial view of a further modification of the cavity supporting and moving mechanism shown in FIGS. 2–6.

FIGS. 5–7 illustrate further modifications of the cavity insert actuating means shown in FIGS. 1–4.

In FIG. 5 a cantilever mechanism 25 is shown comprising a plate 26 slotted at each end, as shown, for each receiving the pinned end of one of a pair of lever arms 27 and 28. These lever arms are pivotally connected between their ends at a point 29. The other end of lever arm 28 is pivotally mounted on frame 12. The other end of lever arm 27 is pivotally attached to a piston rod 30 of a suitable fluid acuating means 31. Thus, as the piston rod moves in and out of its cylinder 32, the plates 26 are moved into and out of cavity 16 in the mattress supporting structure or box spring 13 to move the cavity inserts 13C and 14C relative to the box spring and mattress as heretofore explained.

FIG. 6 illustrates a modification of the structure shown in FIG. 5 wherein the fluid actuating means 31 is replaced with a suitable motor such as a stepping motor 33 and a threaded rod 34 threadedly associated with an ear 35 on the free end of lever arm 27 connected to any suitable source of electric power 36, such as a battery or domestic electric power source, controlled by a suitable electric switch 36'.

FIG. 7 discloses a further modification of the fluid actuating means shown in FIGS. 2–6 wherein the electric motor 33 is connected by suitable gear means 37 to a threadedly connected supporting rack 38. This mechanism controllably moves the rack 35 to lift or lower the cavity insert 14C of the mattress. In this instance rack 38 replaces the cavity insert 13C of the box spring shown in FIGS. 2–6.

It should be noted that the diagrammatic illustrations shown in FIGS. 2–7 are intended to show various mechanisms for raising and lowering inserts for the cavities shown in the mattress and bed springs and not their relative positions on the bed. This invention is intended to cover any desirable arrangement on the bed of the claimed elements.

Although but a few embodiments of the present invention have been illustrated and described, it will be apparent to those skilled in the art that various changes and modifications may be made therein without departing from the spirit of the invention or from the scope of the appended claims.

What is claimed is:

1. A mattress structure useable by pregnant women comprising:

a resilient body comprising a mattress having upper and lower surfaces and a cavity extending downwardly from said upper surface and through said lower surface to accommodate the expanding abdomen of a woman in full term pregnancy, an insert for said cavity comprising a part of said mattress and substantially the same shape as said cavity but slightly smaller for movement longitudinally in said cavity, a cover for the top of said mattress, the walls of said cavity and the top of said insert forming a support for the abdomen of a pregnant woman resting on the upper surface of said body, and means mounted on the structure for selectively moving said insert longitudinally of said cavity and maintaining it in a given location, said cover adjacent said insert deforming to follow it upon movement in said cavity and outlining said cavity at any position of said insert, whereby a woman may selectively fill the cavity to form a complete upper surface of said body or enlarge or decrease the size of said cavity according to the size of her abdomen.

2. The mattress structure set forth in claim 1 wherein:

said resilient body further comprising a box spring, and said cavity extending through said mattress and said box spring in axial alignment.

3. The mattress structure set forth in claim 1 wherein:

said means comprises a hand crank mechanism.

4. The mattress structure set forth in claim 1 wherein:

means comprises an elecric motor actuated cantilever mechanism.

* * * * *